United States Patent [19]

Richardson

[11] Patent Number: 4,723,487

[45] Date of Patent: Feb. 9, 1988

[54] SCREEN PRINTING METHOD AND APPARATUS

[76] Inventor: Orland W. Richardson, 5730 Sinclair Rd., Columbus, Ohio 43229

[21] Appl. No.: 832,514

[22] Filed: Feb. 21, 1986

Related U.S. Application Data

[63] Continuation-in-part of Ser. No. 727,019, Apr. 25, 1985, Pat. No. 4,649,815.

[51] Int. Cl.[4] ..... B41F 15/18

[52] U.S. Cl. ..... 101/126; 101/112

[58] Field of Search ..... 101/112, 114, 115, 126; 400/354, 354.1

[56] References Cited

U.S. PATENT DOCUMENTS

| | | | |
|---|---|---|---|
| 1,000,496 | 8/1911 | Cole | 101/112 |
| 2,532,802 | 12/1950 | Farwell | 101/112 |
| 3,992,989 | 11/1976 | Thompson et al. | 101/112 |
| 4,084,504 | 4/1978 | Fuchs | 101/126 |
| 4,200,402 | 4/1980 | Rix | 400/354.1 |
| 4,201,423 | 5/1980 | Hagen et al. | 400/354 |
| 4,583,458 | 4/1986 | Beachum | 101/112 |

FOREIGN PATENT DOCUMENTS

| | | | |
|---|---|---|---|
| 1124517 | 3/1962 | Fed. Rep. of Germany | 101/112 |
| 72063 | 5/1945 | Norway | 101/112 |

*Primary Examiner*—William Pieprz
*Attorney, Agent, or Firm*—Francis T. Kremblas, Jr.

[57] ABSTRACT

A screen printing apparatus particularly useful for printing numerals on athletic wear characterized by a plurality of printing head assemblies, each of which include a screen receiving socket, are mounted in a horizontal extending side by side relationship in a plane disposed above a printing station provided with a material receiving pallet. The printing head assemblies are slideably carried on a frame support for selective horizontal movement of a given printing head assembly over the pallet. Each printing head assembly is mounted to a sliding frame or carriage for independent vertical pivotal movement toward and away from the pallet to define a printing and non-printing position. Means are also provided to releasably and selectively fix each of the printing head assembly means with a screen mounted thereon in one of a plurality of printing positions overlying the pallet upon pivoting the printing head disposed directly over the pallet to a printing position. Therefore using only ten printing heads each carrying a single digit numeral in a single color from 0 to 9 permits the printing of any numberal in the series of 0 to 99 without the need to remove any printing screens from the printing head.

6 Claims, 6 Drawing Figures

SCREEN PRINTING METHOD AND APPARATUS

This application is a cotinuation-in-part application of my co-pending application Ser. No. 727,019 filed Apr. 25, 1985, now U.S. Pat. No. 4,649,815 of Mar. 17, 1985.

BACKGROUND

Screens used in direct screen printing are typically made using a photographic process to create the desired image on the screen. Therefore the screen and its associated frame must be accurately located when mounted on the printing apparatus to assure proper placement of the printed image onto the garment which is held on the pallet of the apparatus. The screen frame must be registered or positioned in lateral, vertical and longitudinal directions relative to the pallet and the material mounted thereon to assure quality of the printing process. When more than one color is necessary, the precise registration or positioning becomes even more critical. Such screens are removably mounted to a printing head which forms a portion of the printing apparatus.

Screen printing has grown over the past several decades into a very high volume business. One of the larger segments of this industry requires the printing of numerals upon athletic shirts and jerseys for high school, college, professional and amateur athletic teams as well as for casual wear sport jerseys and T-shirts.

Most athletic jerseys and shirts include numerals on the back and front. The more elaborate and expensive jerseys include numbers on the sleeves or shoulders. In many applications, a two color design is required wherein the primary numeral is bordered in a second color. Typically the front, back and sleeve numerals are of different sizes which require three separate screen designs for each numeral used.

Prior to the present invention, athletic shirt manufactureres were required to have a stock of approximately 100 silk screens including the frame, to represent the numerals 0 to 99 for each color and each size to be used. Another 100 screens in each size were required for a two color numeral printing. Therefore shirts or jerseys having two-color front and rear numerals required a total of 400 individual printing screens. If sleeve or shoulder numerals are included, an additional 200 screens were needed.

Further, after each numeral has been printed, each screen must be removed and another screen positioned and fixed onto the screen printing head assembly which lies above the pallet upon which the workpiece garment is placed. On conventional apparatus, this procedure required the user to loosen set screw type fastening devices, remove the screen, replace the new screen and accurately re-position the new screen by manual eye alignment prior to re-tightening the screw-type fastening devices.

In two-color processes, the precise placement or registration of the first and second color screens is imperative to assure that the outline secondary color is properly printed along the outer borders of the primary numeral color in the desired alignment.

The above procedure represented a cumbersome technique and a very high investment in inventory screens and frames. Further, it required skilled screen designers using great care and careful operators to assure proper positioning of the silk screens to avoid an unreasonably high number of rejected final products.

Another process used for direct numeral printing on such garments is referred to as the die cut process. In this process, a paper sheet is employed for each numeral image to be printed which is discarded after a single use. Each new die cut sheet must be replaced in a fixed frame manually.

Those skilled in the art have failed to find a satisfactory solution to these long recognized disadvantages, therefore volume manufactureres have been required to continue to use these old and well-known cumbersome processes to print numeral indicia on such garments using the prior conventional printing apparatus.

SUMMARY OF INVENTION

The present invention relates to printing screen apparatus and particularly to a construction which provides a plurality of screen printing heads which are slideably mounted for selective positioning of one of the printing heads and its associated printing screen over the material receiving pallet. The apparatus is particularly adapted for printing numerals on shirts and jerseys or the like. While in principle, it may be employed with otherwise conventional single or multiple station machines or with conventional single or multiple color machines, its most practical application is directed to high volume applications utilizing modern multiple station and multiple color apparatus.

The screen printing head assemblies of the present invention are mounted on a carriage member in adjacent side-by-side relationship to one another in a horizontal plane near a horizontally disposed pallet defining a printing station. Preferably, the pallet is one of a plurality mounted for rotation in an indexed manner to the printing station as one position among a plurality of other operations, such as drying and loading, for example. The carriage member is slideably mounted on a support frame such that each of the printing head assemblies carrying a given printing screen may be selectively positioned over the pallet. Each printing head assembly is independently pivoted for movement toward or away from the pallet between a printing and non-printing position relative to a printing screen mounted thereon and the pallet.

Further, a registration plate member is provided on an arm mounted to the support base carrying the pallets in a precise position relative to a pallet at the defined printing station. The registration plate cooperates with a post member provided on the printing head assembly to releasably fix the printing head assembly in one of a plurality of laterally spaced predetermined printing positions in a registered relationship to the pallet upon downward pivoting of the printing head assembly.

Each printing head assembly is provided with a screen receiving mounting means which may be conventional or preferably similar to the screen mounting socket disclosed in my above-identified earlier filed application. As described therein, this socket portion cooperates with the leading end of a screen frame to automatically locate the screen in the printing head in the same longitudinal and lateral position every time a screen is mounted relative to the predetermined location of the pallet in the printing position.

As described in my above-identified earlier filed application, the ability to quickly and accurately locate the printing screen in multiple predetermined registered positions relative to the pallet permits the user to employ, for example, merely ten screens representing the single digits from 0 to 9 to print any consecutive numeral in a 100 numeral series, such as 0 to 99. In accordance with the present invention, the multiple printing head construction disclosed herein eliminates the need to remove and replace each screen in a printing head assembly when another numeral of the same size and color is to be printed. The operator merely slides the carriage member to align the printing screen having the desired numeral image over the pallet and the position of the registration plate desired and lowers the printing head and its associated screen to the desired registered position. There is no reason to change printing screens until a complete run is made and either a different color or numeral size is required. Larger operations may benefit by having a plurality of such printing apparatus as described herein such that the screens need not be removed from a given apparatus until a different color or numeral image must be printed.

The elimination of frequent screen replacement as required by prior art screen printing apparatus represents a very drammatic saving of time and labor. In conjunction with the use of the screen-receiving socket technique, manual alignment errors of the screens relative to the desired printing position are eliminated to assure high quality of the consistency of image placement upon the material being printed. A very drammatic increase in production can be realized compared to the prior art utilizing the principle and operation of the apparatus constructed in accordance with the present invention.

OBJECTS

It is therefore an object of the present invention to provide an improved screen printing apparatus which permits a drammatic reduction in printing screen inventory and an increase in production compared to the prior art.

It is another object of the present invention to provide an apparatus of the type described wherein a large series of numeral images from 0 to 99, for example, may be printed employing only ten printing screens without the need to remove and replace any screen from their printing head assembly during the printing run.

It is another object of the present invention to provide an apparatus of the type described wherein one of a plurality of printing head assemblies and its associated printing screen may be easily located in a predetermined printing position and precisely aligned in one of a plurality of predetermined horizontally spaced positions registered relative to a pallet at a defined printing station in a consistently accurate manner.

It is another object of the present invention to provide an apparatus of the type described which is relatively simple to manufacture and use, yet, provides the advantages referred to above herein.

IN THE DRAWINGS

DETAILED DESCRIPTION

A screen printing apparatus constructed in accordance with the present invention is illustrated in FIGS. 1–6. For purposes of illustration only, the present invention is described in connection with a multiple station, two color, printing apparatus which includes a conventional and well-known indexing table, indicated generally at 20, which supports and rotates a plurality of pallets, such as the pair indicated at 22, in a well-known manner. Merely for purposes of brevity, only some of the pallets 22 and their associated support arms are shown which should be sufficient to permit the invention to be described and understood in a clear manner by those skilled in the art.

To avoid unnecessary detail, well-known to those skilled in the art, the conventional aspects of the multiple station two color indexing table and support 20 will be described in general terms only as far as necessary to understand the operation of the improvement represented by the present invention in a context recognized by those skilled in the art.

Figure 1:
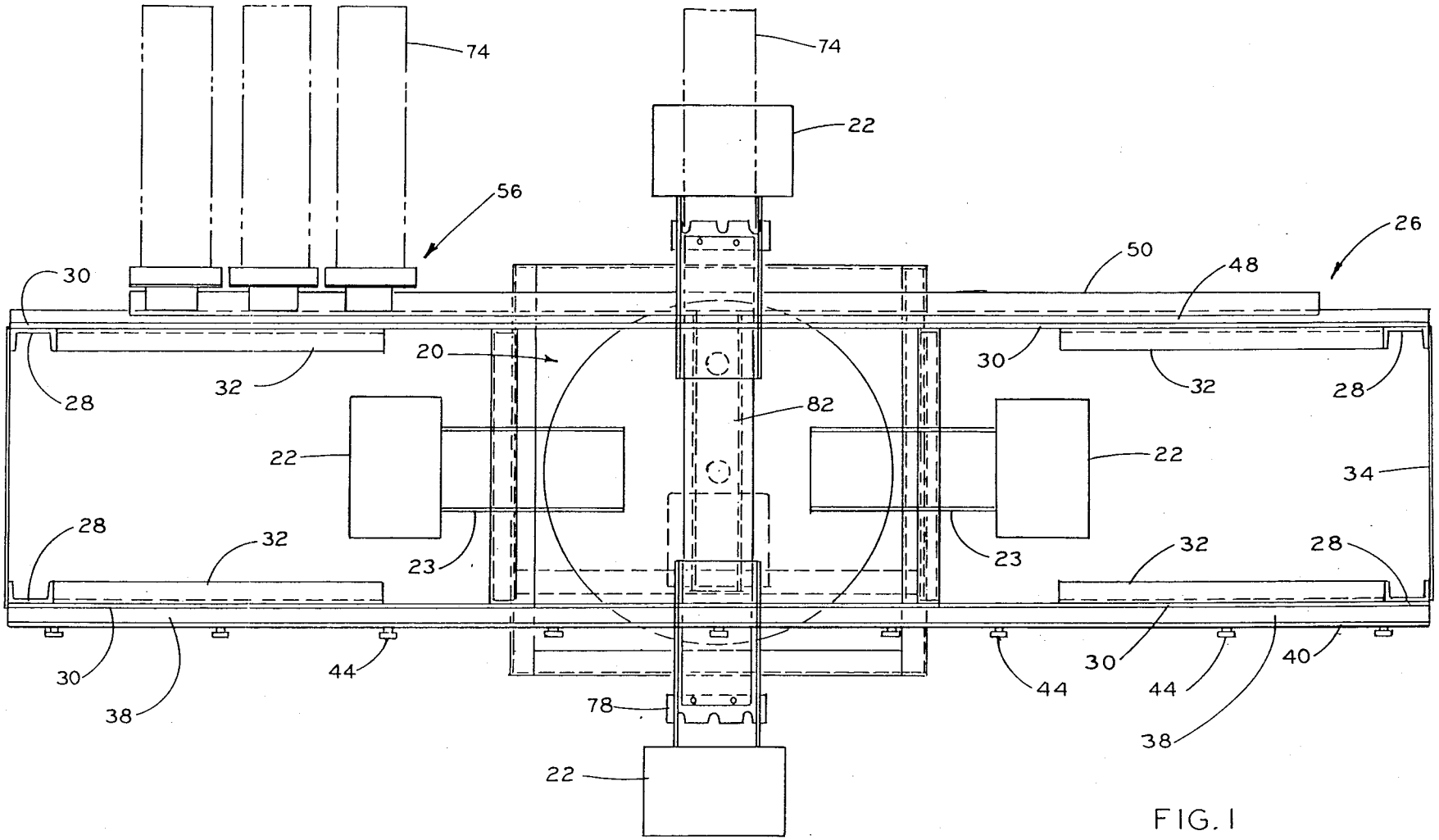
FIG. 1 is a top plan partial view of a screen printing apparatus constructed in accordance with the present invention illustrating the sliding carriage and frame support in relationship to a partial view of an associated conventional multiple station, multiple pallet device.
Figure 2:
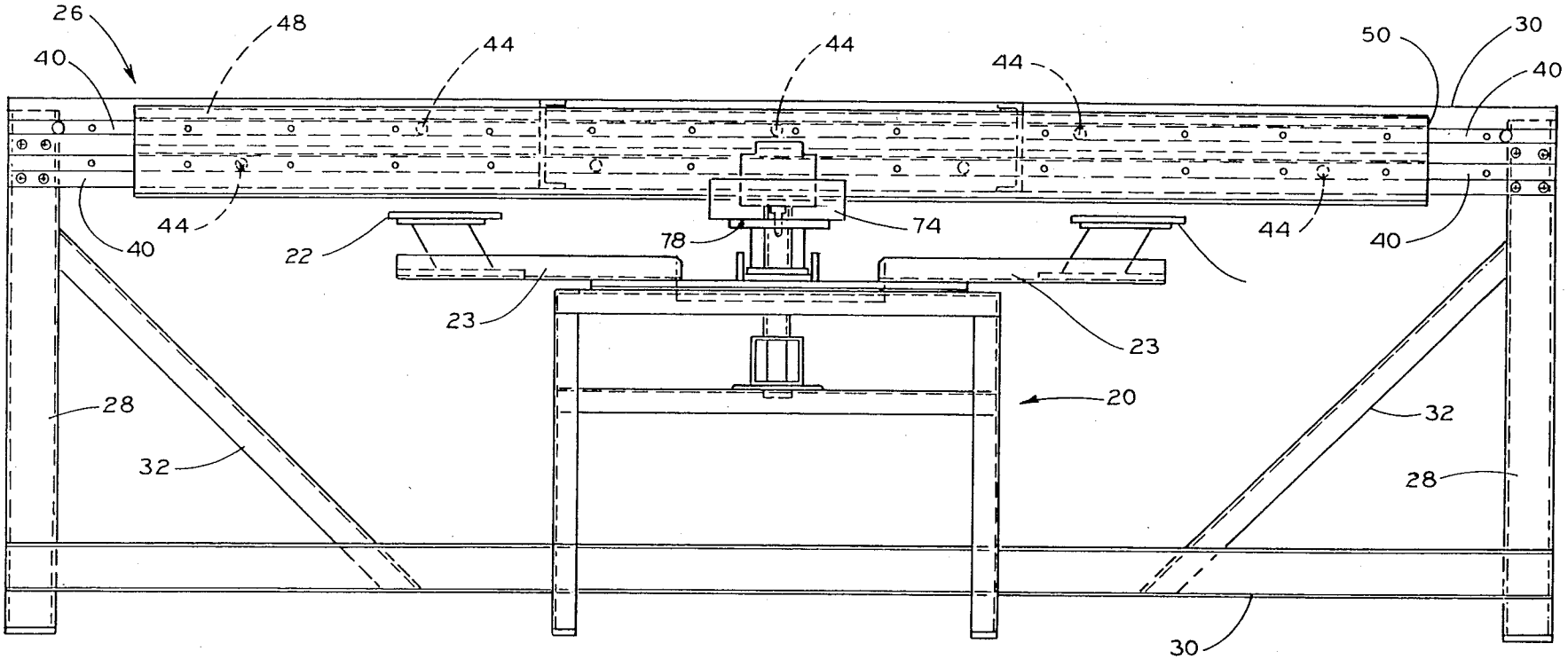
FIG. 2 is a front elevational view of the apparatus shown in FIG. 1, illustrating the pallets mounted on a conventionally constructed rotatably indexing table and one printing head and screen at the printing station.
Figure 3:
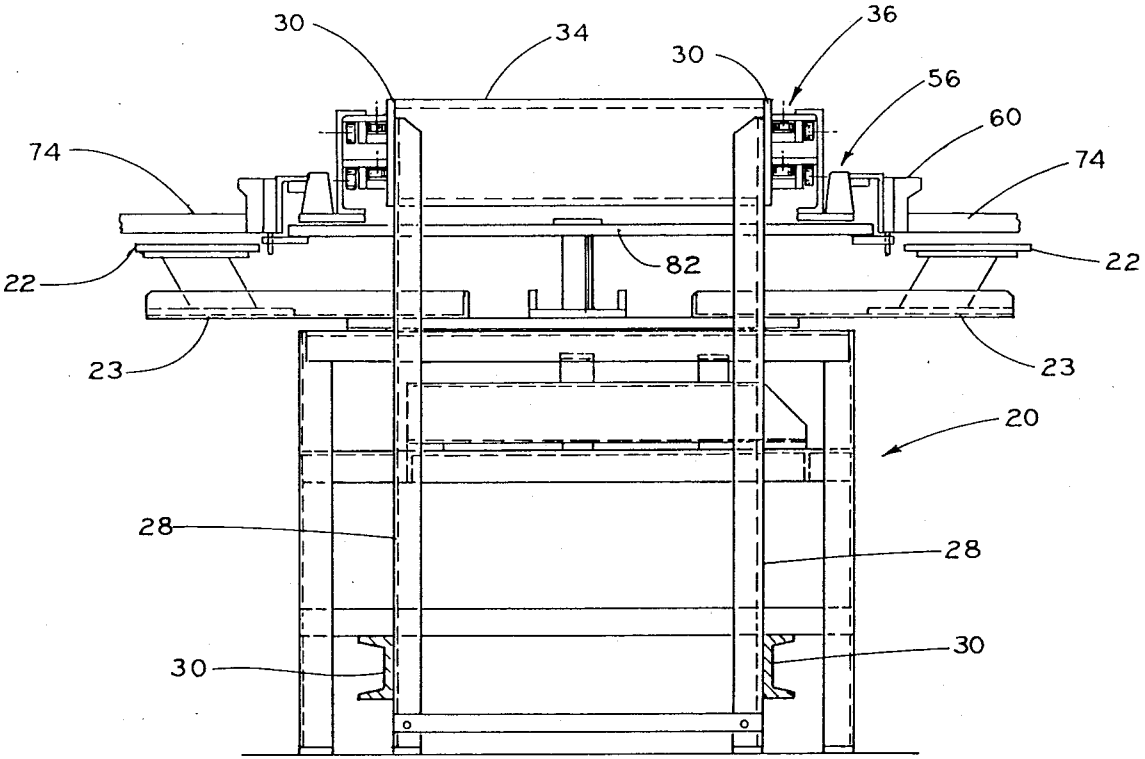
FIG. 3 is an end elevational view of the apparatus shown in FIG. 1 which includes the printing head assembly means forming a portion of the present invention.

With reference to FIGS. 1–3, conventional rotatable indexing table and associated frame, indicated generally at 20, includes a plurality of radially extending arms, such as 23, upon which conventional material receiving pallets shown at 22 are fixed. In a well-known manner, the indexing table 20 sequentially rotates each of the arms 23 and pallets 22 through a predetermined arc to a plurality of positions associated with the screen printing process. Such positions include, for example, loading, printing and drying stations. A six or eight position, two color machine may include a second set of printing, drying and loading stations. For purposes of the present invention, only the printing station is of prime consideration as it relates to positioning a printing head assembly carrying a screen into a printing position overlying the pallet.

An elongate printing head assembly support frame, indicated generally at 26, includes vertical legs 28, upper and lower horizontal beams 30, and angle supports 32.

Since two oppositely disposed printing stations are included in the two color printing apparatus referred to herein, support frame 26 includes end members 34 connecting oppositely disposed frame members 28, 30 and 32 such that the multiple printing head assembly of the present invention may be identically duplicated in operative association with two oppositely disposed printing stations which are present in a two color printing apparatus. For use in two color numeral applications, the entire two color printing process may be economically completed with one indexing table and duplicate multiple printing head assembly means in accordance with the present invention. However, it should be readily understood that if only one printing station for one color is provided, only one multiple printing head assembly constructed in accordance with the present invention would be necessary.

The support frame 26 is positioned with respect to the indexing table 20 in a manner to align the frame members 30 at a right angle to the radially extending arm 23 carrying a pallet, such as 22, indexed to the predetermined printing station such as shown in FIG. 3. The lower members 30 are fixed to cross supports of indexing table and support 20 to assure maintaining the proper alignment relationship between the support frame 26 and the printing stations which the pallets 22 are located during operation.

It should be pointed out that the printing head assemblies and other details described later herein are not fully included in FIGS. 1 and 2 to better illustrate the remaining structure of the support frame 26 and associated sliding carriage structure supporting the printing head assemblies.

Figure 5:
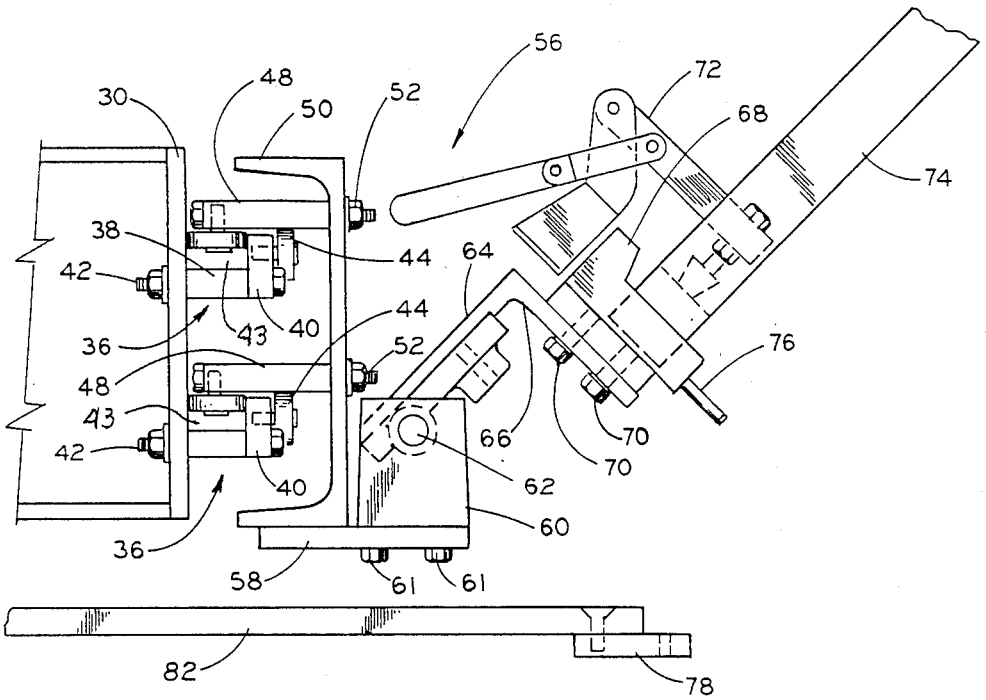
FIG. 5 is a partial side elevational view of the portion of the apparatus shown in FIG. 4 illustrating the printing head assembly, the carriage and the guide means mounted to an associated portion of the support frame.
Figure 6:
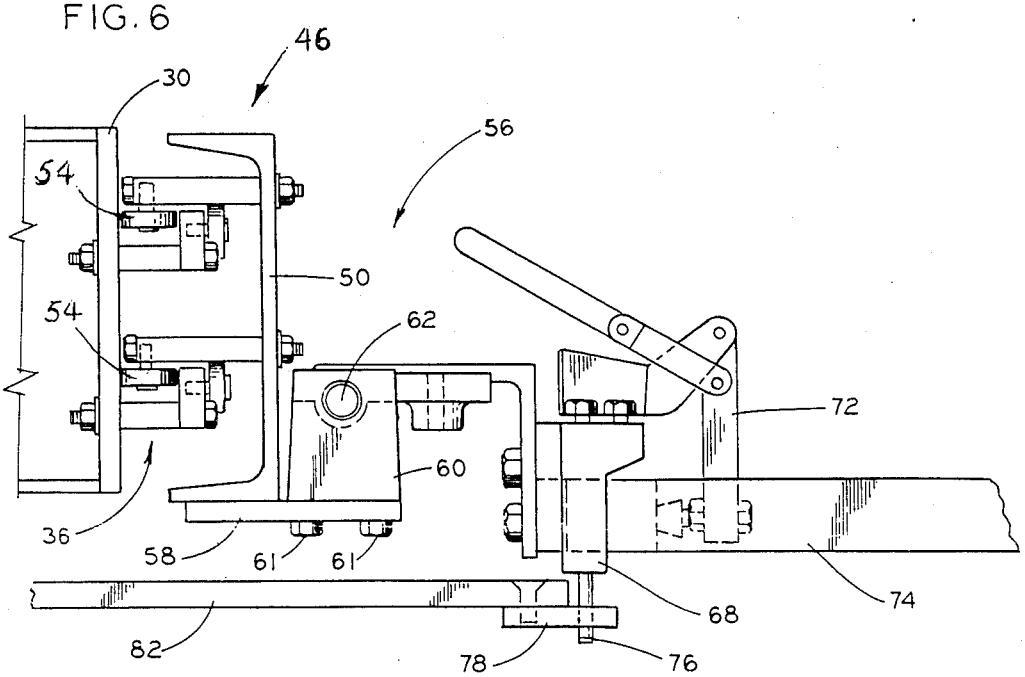
FIG. 6 is a similar view to that shown in FIG. 5 illustrating the printing head and screen lowered to the printing position.

As best seen in FIGS. 3 and 5, upper horizontal support 30 of frame 26 comprises a vertically disposed plate to which a pair of horizontally disposed guide assemblies, indicated generally at 36 are mounted. Each guide assembly 36 includes a pair of bar members 38 and 40 fixed to one another and support plate 30 via a plurality of horizontally spaced bolts, such as at 42. This structure forms a channel 43 between the vertical walls of support 30 and the respective bars 40. A plurality of horizontally spaced bearings 44 are rotatably mounted about a horizontal axis to bars 40 with their upper surface extending slightly above the top of the respective bar 40.

A support carriage, indicated generally at 46, is slideably mounted upon guide assemblies 36 and includes a pair of flat plates 48 forming horizontally extending rails along the length of a carriage beam 50. Plates 48 are fixed to beam 50 by a plurality of horizontally spaced bolt assemblies, such as 52. A plurality of horizontally diposed bearing members 54 are rotatably mounted along a vertical axis at laterally spaced intervals along the length of beam 50 near the inner ends of plates 48. The downward thrust of the weight of carriage 46 is primarily supported by bearings 44. Bearing members 54 maintain contact with one of the vertical walls of channel 43 defined between plate 30 and bars 40 to provide a freely slideable motion to carriage 46 along the path defined by guide assemblies 36. A stop, not shown, may be provided near the ends of each channel 43 to define a limit to the horizontal travel of carriage beam 50.

A plurality of horizontally spaced printing head assemblies, indicated generally at 56, are provided for applications for printing numerals on athletic jerseys. Preferably at least ten such printing heads are employed, each carrying a printing screen provided with a single digit numeral image representing the series 0 through 9.

Each printing head assembly 56 is mounted in a fixed lateral position on beam 50 but is pivotally mounted for vertical movement between a raised and lowered position defining a non-printing and printing position respectively.

Figure 4:
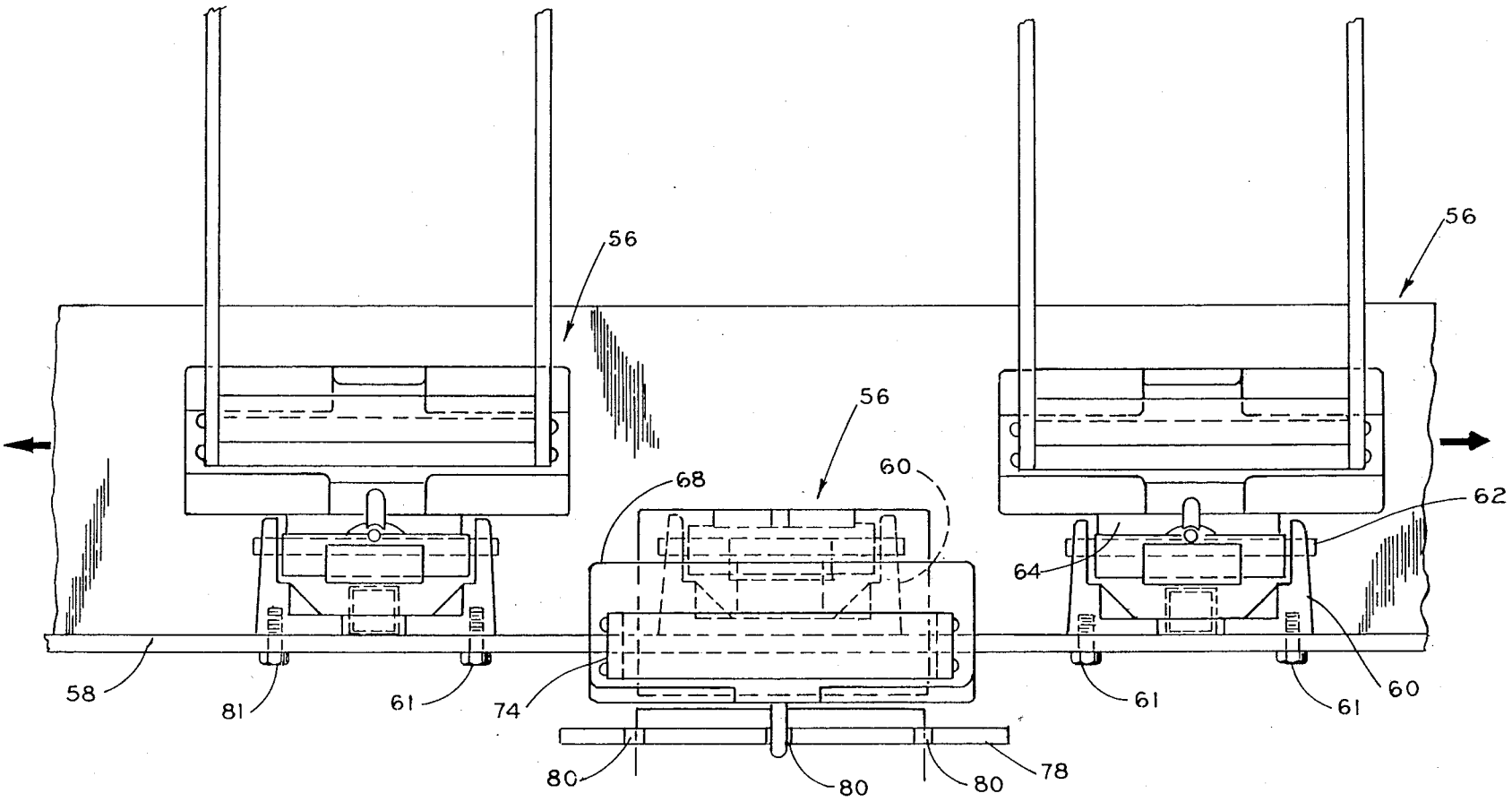
FIG. 4 is a partial front elevational view of a portion of the apparatus shown in FIG. 1 illustrating part of the multiple printing head assembly means mounted to the sliding carriage in accordance with the present invention.

Referring specifically to FIGS. 4 and 5, a horizontally disposed base plate 58 extending the length of beam 50 is securely fixed to the lower end thereof in any conventional manner by bolts, or the like, not shown. Each printing head assembly 56 includes a pivot block 60 fixed via appropriate bolts 61 to plate 58. Pivot block 60 supports a horizontal pivot pin 62 upon which a support arm or conventional hoe 64 is rotatably mounted in a conventional manner. Arm 64 conventionally permits longitudinal adjustment of the location of block 60 relative to pallets 22 and includes a downturned flange 66 to which a screen mounting block 68 is fixed via bolts 70. Arm 64 is similar in this respect to the construction of the hoe described in my co-pending application Ser. No. 727,019 referred to earlier herein. Block 68 also includes a rectangular shaped recess which is adapted to receive a forward end of a printing screen in very close tolerance fit to accurately position the screen relative to vertical, lateral and longitudinal attitudes. A conventional toggle clamp 72 may be employed to secure a screen, indicated at 74, in the recess during operation.

Each screen mounting block 68 includes a fixed pin member 76 extending vertically downward to cooperate with a registration plate 78 to releasably fix each printing head assembly in one of three predetermined laterally spaced positions represented by slots 80 provided in registration plate 78. Registration plate 78 is mounted to a cross bar 82 which in turn is fixedly mounted to the central portion of indexing table and frame 20 in a conventional manner. In the embodiment shown having two oppositely disposed printing stations, an identically constructed frame, carriage and printing head assemblies are provided. A second registration plate 78 is identically mounted on the opposite end of cross bar 82. The positioning of registration plate 78 during manufacture and assembly accurately locates the desired registration position of a respective printing head and its associated screen relative to a pallet disposed at the printing station.

It should be readily understood that each printing head assembly 56 may be first horizontally moved by sliding carriage 36 and then lowered into one of any of the three laterally spaced slots 80 shown. This fixes the associated printing screen 74 in a given registered position relative to the athletic jersey fixedly positioned upon the pallet 22.

In a manner as similarly described in my aforementioned co-pending application Ser. No. 727,019, a screen carrying a single digit numeral may be easily positioned in a left, right or center position as may be necessary to print a single or multiple digit numeral.

Since all printing head assemblies 56 are readily movable to a position above the pallet disposed at the defined printing station, any numeral from 0 to 9 may be quickly moved to the operative location and pivoted downwardly into a printing position overlying the pallet in either the left, right or center position defined by slots 80.

Therefore, for example, the operator may print any numeral from 0 to 99 in this manner using only ten screens mounted on a single apparatus and never have to remove and replace a screen until the color or the size of the numerals to be printed are changed.

In certain applications, a customer may desire special positioning of a certain numeral. In such cases this can be easily accomodated by adding one or two printing heads and screens carrying the special numeral image to the carriage assembly to provide for this result while the remaining ten screens are employed as described.

The present invention not only reduces the necessary inventory of screens needed for jersey numeral printing by at least ten fold for typical applications such as taught by my co-pending application Ser. No. 727,019, but it further reduces the labor and time required and dramatically increases production.

As compared to prior art methods and means, the ten fold decrease in printing screen inventory permitted using the present invention in conjunction with a very significant increase in productive capacity and labor efficiency represents a very large forward step in this art. It should also be noted that the increase in production is accomplished with no sacrifice in reproducible quality and in fact generally represents an improvement in quality by reducing the opportunity for operator alignment errors which are prevalent in prior art methods and means.

What is claimed is:

1. A screen printing apparatus comprising in combination, a base supporting at least one material receiving pallet extending outwardly from said base to define a printing station; a support frame extending longitudinally above and generally at a right angle to said printing station; a plurality of printing head assemblies mounted on said support frame in adjacent side by side relationship to one another, each of said printing head assemblies includes a screen receiving mounting means and each are independently mounted relatively to one another for vertical pivotal movement toward and away from said pallet to define a lower horizontally disposed printing position and an upraised non-printing position; said printing head assemblies being slideably mounted to said support frame for longitudinal displacement of said printing head assemblies in a horizontal plane over said printing station when disposed in said raised non-printing position, and each including first locating means thereon, cooperable, when in the lowered printing position, with one of a plurality of second locating means on said base to releasably fix said screen mounting means in one of a plurality of printing locations overlying said printing station.

2. The apparatus defined in claim 1 wherein said plurality of printing locations overlying said pallet are related to a predetermined registered location for imprinting an image in one of three laterally spaced positions onto the material disposed on said pallet.

3. The apparatus defined in claim 1 wherein said locating means include a downwardly extending pin provided on each respective one of said printing head assemblies and a horizontally extending registration plate fixed to said base in a predetermined position relative to said printing station and provided with at least three laterally spaced slots for receiving said pin upon pivoting a printing assembly aligned above one of said slots to said printing position.

4. An improved screen printing apparatus having a base rotatably supporting a plurality of radially outwardly extending pallets about a vertical axis, said pallets adapted to receive a flexible material and being movable to a defined printing station; an elongate frame extending in a horizontal direction at a right angle to a pallet disposed at said printing station and disposed closely adjacent thereto; a carriage means slideably mounted to said elongate frame for horizontal travel along the length of said support frame at a predetermined distance above a horizontal plane defined by a pallet disposed at said printing station; a plurality of printing head assemblies, each including a screen receiving mounting means and mounted in a laterally fixed adjacent relationship to one another on said carriage means, each of said printing head assemblies being independently pivoted to said carriage means along an axis parallel to the horizontal plane of travel of said carriage means for vertical movement toward and away from said pallet disposed at said printing station to define a lowered printing and raised non-printing position; said printing head assemblies being longitudinally displaced upon sliding of said carriage means over said pallet at said printing station when disposed in said raised non-printing position, and each including first locating means thereon, cooperable when in the lowered printing position, with one of a plurality of second locating means on said base to releasably fix said screen mounting means in one of a plurality of printing locations overlying said pallet.

5. The apparatus defined in claim 4 wherein said elongate frame includes a longitudinally extending, vertically disposed support wall; a pair of parallel guide means mounted on said support wall in vertically spaced relationship to one another to define a pair of parallel extending channels having vertical side walls and a top opening extending along the length of said frame; a plurality of laterally spaced first bearing members rotatably mounted about a horizontal axis to said guide means; said carriage means slideably mounted along the length of said guide means and including a support beam extending horizontally along at least a portion of the length of said channels, a pair of parallel extending horizontally disposed rails fixed to said support member and freely resting upon said first bearing members, a plurality of laterally spaced second bearing members rotatably mounted about a vertical axis near the inwardly extending end of a respective one of said rails and extending into a respective one of said channels in a force bearing relationship against at least one of the vertical walls defining a respective one of said channels.

6. A screen printing apparatus for printing numeral indicia upon athletic clothing comprising, in combination, (a) a base rotatably supporting a plurality of material receiving, radially extending pallets about a vertical axis between a plurality of predetermined positions, at least one of said positions defining a printing station having said pallet disposed in a horizontal extending plane;

(b) a support frame mounted in adjacent relationship to said base means and including a plurality of printing head assemblies mounted thereto in a horizontally spaced relationship to one another along a line at right angles to the radial line defining said printing station;

(c) said printing head assemblies beign slideably mounted to said support frame along a common plane disposed a given distance from a pallet disposed in said printing position and each also being independently pivoted to said support frame for vertical movement between a vertically raised non-printing position and a lowered printing position;

(d) screen receiving means provided for each of said printing head assemblies and including a socket-like recess facing outwardly toward said printing station and disposed to position a printing screen mounted in said recess in a parallel relationship overlying a pallet disposed at said printing station when said printing head assembly is disposed in a printing position;

(e) a registration plate fixedly mounted to said base means and extending toward said printing station and including at least three outwardly facing laterally spaced slots defining predetermined registration positions and cooperable with a locating means on each of said printing head assemblies related to the desired location of imprinting a single or double digit numeral image upon said athletic clothing positioned upon a pallet disposed at said printing station; whereby any selective one of a consecutive series of at least 100 numerals may be printed with ten printing head assemblies, each carrying a printing screen having a different one of a single digit numeral image chosen from the series 0 to 9 without replacing any of said screens in said printing head assemblies.

* * * * *